United States Patent [19]

McCallister et al.

[11] Patent Number: 4,595,917

[45] Date of Patent: Jun. 17, 1986

[54] DATA PROCESSING TECHNIQUE FOR COMPUTER COLOR GRAPHIC SYSTEM

[75] Inventors: William O. McCallister; Richard M. Katz, both of Greensboro, N.C.

[73] Assignee: Vectrix Corporation, Greensboro, N.C.

[21] Appl. No.: 503,512

[22] Filed: Jun. 13, 1983

[51] Int. Cl.[4] ..... G09G 1/28

[52] U.S. Cl. ..... 340/703; 340/798; 364/521

[58] Field of Search ..... 340/701, 703, 798, 799, 340/800, 801; 358/81; 364/521

[56] References Cited

U.S. PATENT DOCUMENTS

| | | | |
|---|---|---|---|
| 4,016,544 | 4/1977 | Morita et al. | 340/703 |
| 4,150,364 | 4/1979 | Boltzer | 340/703 |
| 4,183,046 | 1/1980 | Dalke et al. | 340/703 |
| 4,217,577 | 8/1980 | Roe et al. | 340/703 |
| 4,408,223 | 10/1983 | Midland | 340/798 |

FOREIGN PATENT DOCUMENTS

| | | | |
|---|---|---|---|
| 2086200 | 5/1982 | United Kingdom | 340/703 |

*Primary Examiner*—Gerald L. Brigance

*Attorney, Agent, or Firm*—Charles R. Rhodes; Judith E. Garmon

[57] ABSTRACT

A frame buffer, divided into three bit planes, is addressed by a single grahic display control chip, whose address signal is altered by an adder to address each bit plane at successive, prescribed time intervals during a single display cycle. A data word of N-bits from each of the first two bit planes is read and latched, then loaded simultaneously with a data word of N-bits from the third bit plane into corresponding shift registers. Thus, the number of memory chips in the frame buffer is minimized and three times the normal data output is achieved during each display cycle.

7 Claims, 6 Drawing Figures

DATA PROCESSING TECHNIQUE FOR COMPUTER COLOR GRAPHIC SYSTEM

BACKGROUND OF THE PRESENT INVENTION

The present invention is directed to a technique in which a conventional NEC 7220 graphic display controller chip accesses three bit planes arranged in a single memory bank of sixteen 64K RAM or memory chips to control the color data to a color monitor made up of approximately 325K pixels.

In a conventional computer graphic system, the display is divided into many tiny dots that can be set to some arbitrary color by a logic system. These dots are called "pixels," which is an abbreviation for "picture elements." Conventionally each pixel includes either three or nine inputs mixtures of which provide different colors. Each pixel is represented in the memory that determines the picture by a series of information bits, which in turn determine the color of any pixel. If each pixel has three bits in memory, then the pixel can ultimately show any one of eight different colors (there are eight combinations of three bits). In the case of nine bit pixels, each pixel can be one of 512 colors.

The memory used to store the picture is called the "frame buffer" which is conceptually a plane of memory bits laid out in a pattern that is similar to the pattern of the pixels on the screen. One conventional screen utilizes a plane of 672 pixels or bits horizontally by 480 pixels or bits vertically. This plane of bits in memory is called a bit plane, since it includes one bit of information for every pixel in the screen. To represent all the bits that each pixel actually receives, the bit planes are imagined to be stacked one after the other, so that each pixel location has as many bits as the stack of bit planes is deep. For example, in the case of a three bit pixel, the frame buffer would include a stack of three bit planes, and in the case of a nine bit pixel, the frame buffer would include a stack of nine bit planes.

In conventional techniques for processing data from a frame buffer to pixels, there is a bit plane provided for each pixel input. Thus, for pixels which are operated by three bits of information (representing three primary colors), there are three bit planes. Accordingly, for pixels that are operated by nine bits of information, there are nine bit planes. Each bit plane has a set of output or transfer lines to its shift register.

It is now conventional in the industry to use 64K RAM's and an NEC 7220 graphic display control chip (GDC). The NEC 7220 graphic display control is designed to work only with sixteen (possibly thirty-two) bit memory. (Other GDC's may require N-bits) Since conventional 64K RAMS are only one bit wide (one output line per address), it is necessary to have sixteen (or N) output or transfer lines and thus at least sixteen memory chips for each bit plane. This provides a memory bank of 1024K bits. However, a 672×480 color monitor requires only approximately 325K bits in each bit plane to satisfactorily provide sufficient operational information. Thus, the frame buffer has approximately 70% of its memory capacity unused.

A second consideration of the conventional setup has to do with time. The NEC 7220 graphic display control chip utilizes an 800 nanosecond display cycle, which means that a new address is generated each 800 nanoseconds. However, only approximately 200 nanoseconds are required to actually address, read, and load a data word of N-bits from the bit plane into the shift register (referred to as a "memory cycle"). Therefore, again, there is approximately 75% of each display cycle of the NEC 7220 control chip which is wasted time.

Thus, there is both wasted time and wasted memory capacity in a conventional graphic data processing technique which utilizes the NEC 7220 control chip and conventional 64K bit wide random access memory chips (RAM). It is desirable, however, to continue using the aforedescribed control chip and memory chips in computer color graphic systems because they are well known, well recognized, and standard in the industry. However, according to the conventional technique the total number of memory chips in a system which operates a 627×480 pixel color minotor would be sixteen (the minimum number per bit plane) times the number of bit planes, or forty-eight memory chips for a three bit plane machine. This is expensive from the standpoint of excessive cost of chips, excessive printed circuit boards, and wasted space. The present invention, therefore, is directed to a technique for using the wasted address space and time, so that a three bit-plane system can operate with only (16) 64K RAM chips.

To accomplish this technique, and in accordance with the present invention, the three bit planes are arranged one after the other in the address space of the frame buffer. Approximately one-third of the data bits from each memory chip is located in each bit plane. Without more, however, each read of the memory would provide data from only one bit-plane, as the NEC 7220 only provides one address for each display cycle. Therefore, since there is sufficient times during each display cycle to perform three reads of the video memory (memory cycles), in the present invention, essentially what is done is to read the first bit plane and latch the data, rather than transferring it to a shift register. Next, a constant is added to the address signal from the NEC 7220 that then locates and reads a data word from the second bit plane, which is then latched without being transferred to the shift register. Finally, a third, higher constant is added to the original address signal from the NEC 7220, which addresses the third bit plane, from which a data word is read. At this time, the three words from three separate bit planes, which have been read during the same display cycle, are loaded into the shift registers simultaneously.

The mechanics of performing these three read cycles are as follows: the row address is strobed into the memory bank as usual, followed by the column address for the first read. After the first memory cycle a second column address is strobed into the memory bank for the second read, and then after the second memory cycle a third column address. The second and third column addresses are generated by adding a constant to the original address signal by an adder means connected between the NEC 7220 and the memory bank.

It should be recognized that while, for the most part, the description has been and will be directed to the processing of data for a three bit pixel system, by duplicating the described technique in three parallel circuits, the same technique could be utilized to advantage in the processing of data for nine bit pixels. Also, if other graphic display control chips operated on N-bits, and if N-memory chips far exceed the number of data bits for each bit plane, the instant invention would be applicable.

Attention is called to U.S. Pat. No. 4,303,986 to Lans, in which some attempt is made to combine data from a memory bank to shift registers to conserve time. What Lans actually does is to group sixteen transfers from a memory bank in to four groups of four bit nibbles, each nibble being transferred simultaneously to one of four separate shift registers. This is not the same concept nor anything like the present invention.

It is therefore an object of the present invention to provide a data processing technique for computer color graphic systems which utilizes to maximum efficiency conventional memory chips, so that the number of chips and associated wiring required may be minimized.

It is a further object of the present invention to provide a data processing technique of the type described in which multiple address signals are presented to a frame buffer during each display cycle, and a data word from the memory bank read during each partial cycle, before the last partial cycle, is latched. Then all data words are loaded into shift registers simultaneously at the end of a display cycle.

Other objects and a fuller understanding of the invention will become apparent from reading the following detailed description of a preferred embodiment along with the accompanying drawings in which.

DETAILED DESCRIPTION OF A PREFERRED EMBODIMENT

Figure 1:
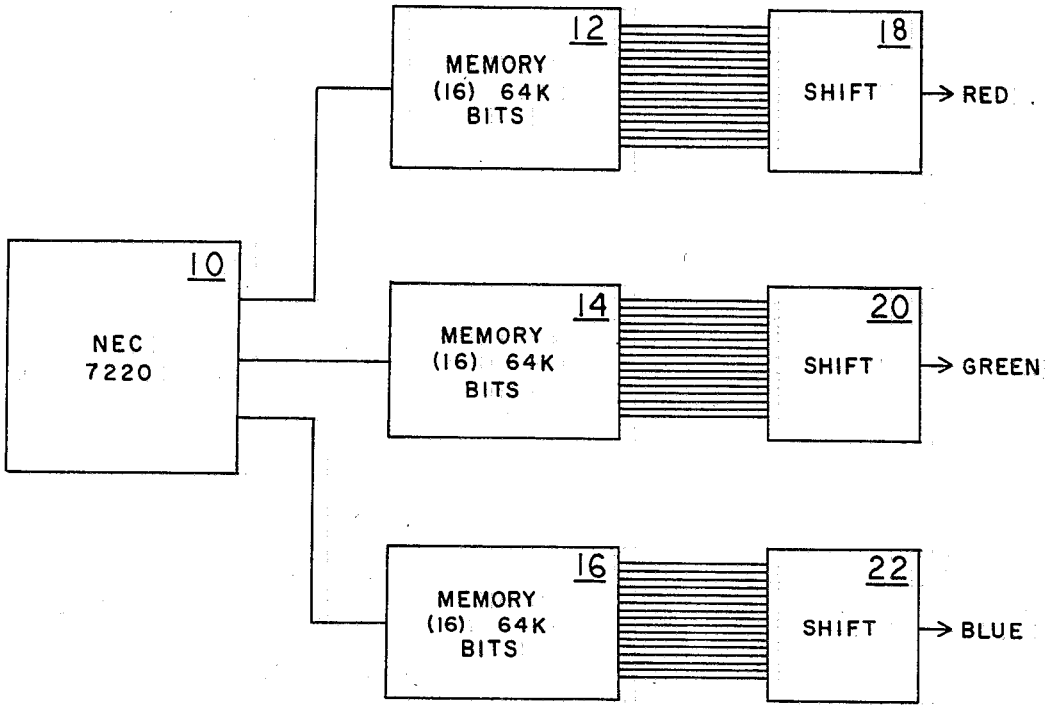
FIG. 1 PRIOR ART
FIG. 1 is a circuit block diagram of a data processing technique for color graphic systems according to the prior art.

Turning now to the drawings, and particularly to FIG. 1, there is illustrated in block diagram form a data processing technique for computer graphic systems according to the prior art. In order to operate a color monitor having 672 pixels×480 pixels with a conventional NEC (Nippon Electric Company) 7220 graphic display control chip, it would be necessary to utilize three bit planes 12, 14 and 16, each having sixteen 64K memory chips therein (a total of 48 memory chips). As explained hereinabove, this is because conventional 64K chips each have one output line and the NEC controller is designed to work with 16 bit words. Therefore, there would be more than 1000K total bits of memory. In operation, in the arrangement of FIG. 1, the NEC 7220 would address first the bit plane 12 (800 nanoseconds), then bit plane 14 (800 nanoseconds), and then bit plane 16 (800 nanoseconds) in order to provide sufficient information to the shift registers 18,20, and 22 to operate the red, green and blue inputs for the pixels. It is possible that there could be a sixteen bit word every 800 nanoseconds for red information, a sixteen bit word each 800 nanoseconds for green information, and a sixteen bit word every 800 nanoseconds for blue information. However, from the drawing it can be seen that the total memory is about three to four times that necessary, and there is approximately 75% of each display cycle which is wasted as far as any reading and loading of information is concerned.

Figure 2:
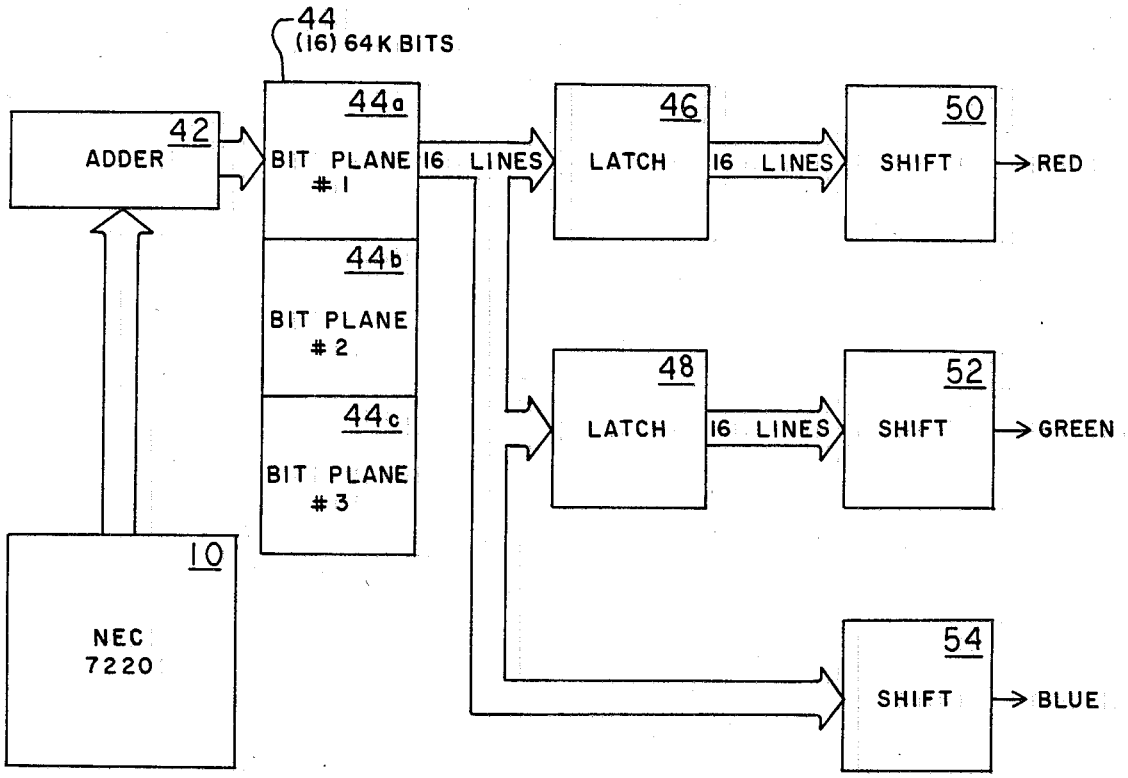
FIG. 2 is a circuit block diagram of a data processing technique according to the present invention.

Turning now to FIG. 2, there is illustrated the setup according to the present invention. Basically the present invention involves the use of a single memory bank 44 comprising only sixteen 64K memory chips divided into three bit planes. This is one-third the number of memory chips required in the conventional setup illustrated in FIG. 1. The use of a single bank of sixteen RAM's 44 is made possible by the use of the adder device 42 between the NEC 7220 chip 10' and the memory bank 44, as well as by the use of latches 46,48 interposed between the memory bank 44 and the shift registers 50 and 52.

So arranged, the address signal from chip 10' which is instituted once during each display cycle is actually divided into three address signals during the same display cycle. This splitting of the initial address cycle is accomplished by the adder device 42 which adds a constant to the address signal that accesses the second bit plane 44*b*, and then the addition of a third constant to the original address signal during the same display cycle which accesses the signal to the third bit plane 44*c*. As soon as the initial signal is received by the first bit plane 44*a*, a word of information (sixteen bits) is read and loaded into latch 46. When the first constant is added to the signal later in the same display cycle, another word of information from the second bit plane 44*b* is read and loaded into latch 48. Finally, upon the addition of the third constant to the original signal, still during the same display cycle, a word from the third bit plane 44*c* is read, and then all information is loaded from the third bit plane, as well as from latch 46 and latch 48 simultaneously into the appropriate shift registers 50,52 and 54. Thus, each display cycle is actually broken down into three memory cycles by the use of adding device 42 and latches 46, 48.

Figure 4A:
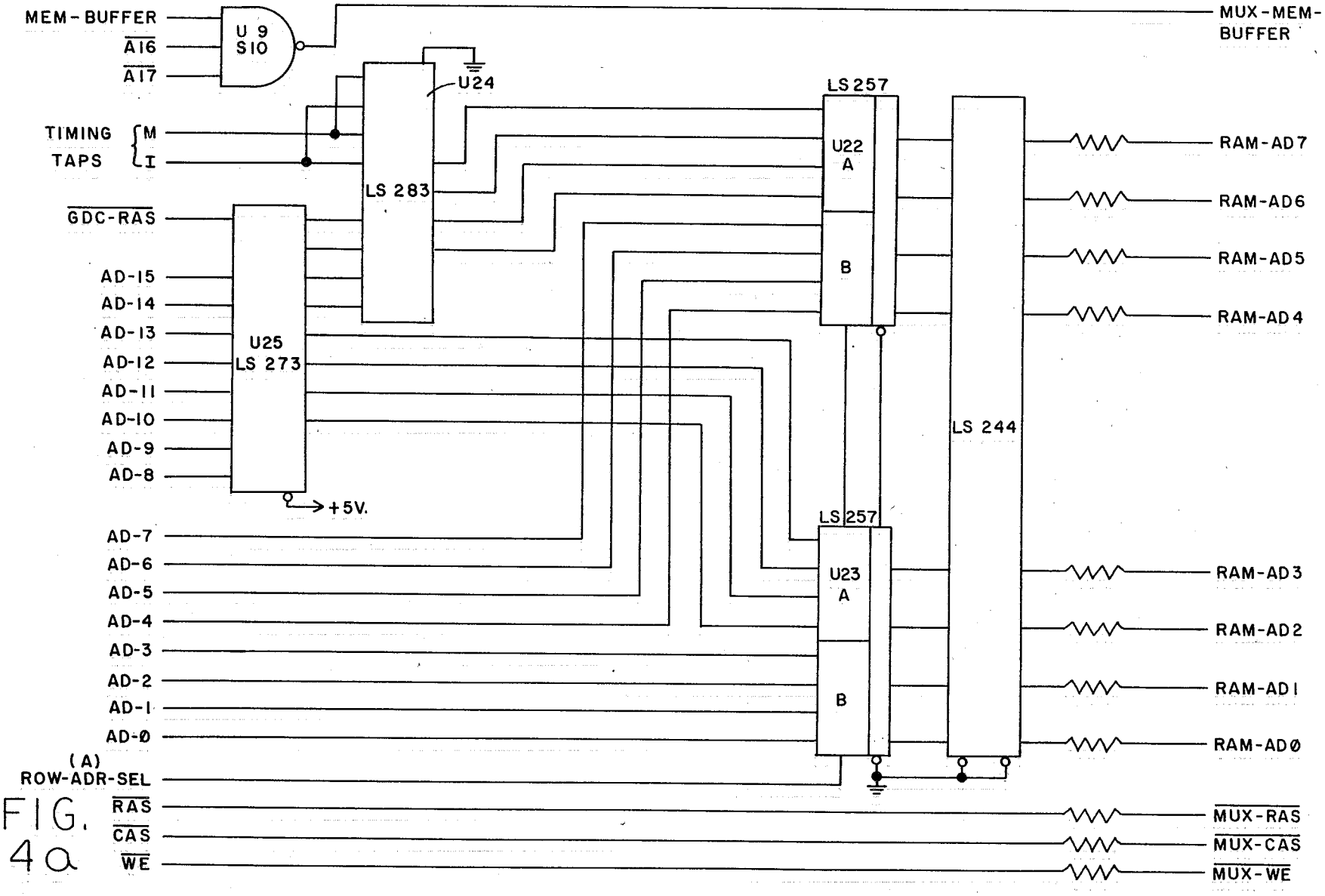
FIGS. 4*a* through 4*c* form collectively a detailed schematic diagram of the display circuitry of the data processing technique according to the present invention.
Figure 4B:
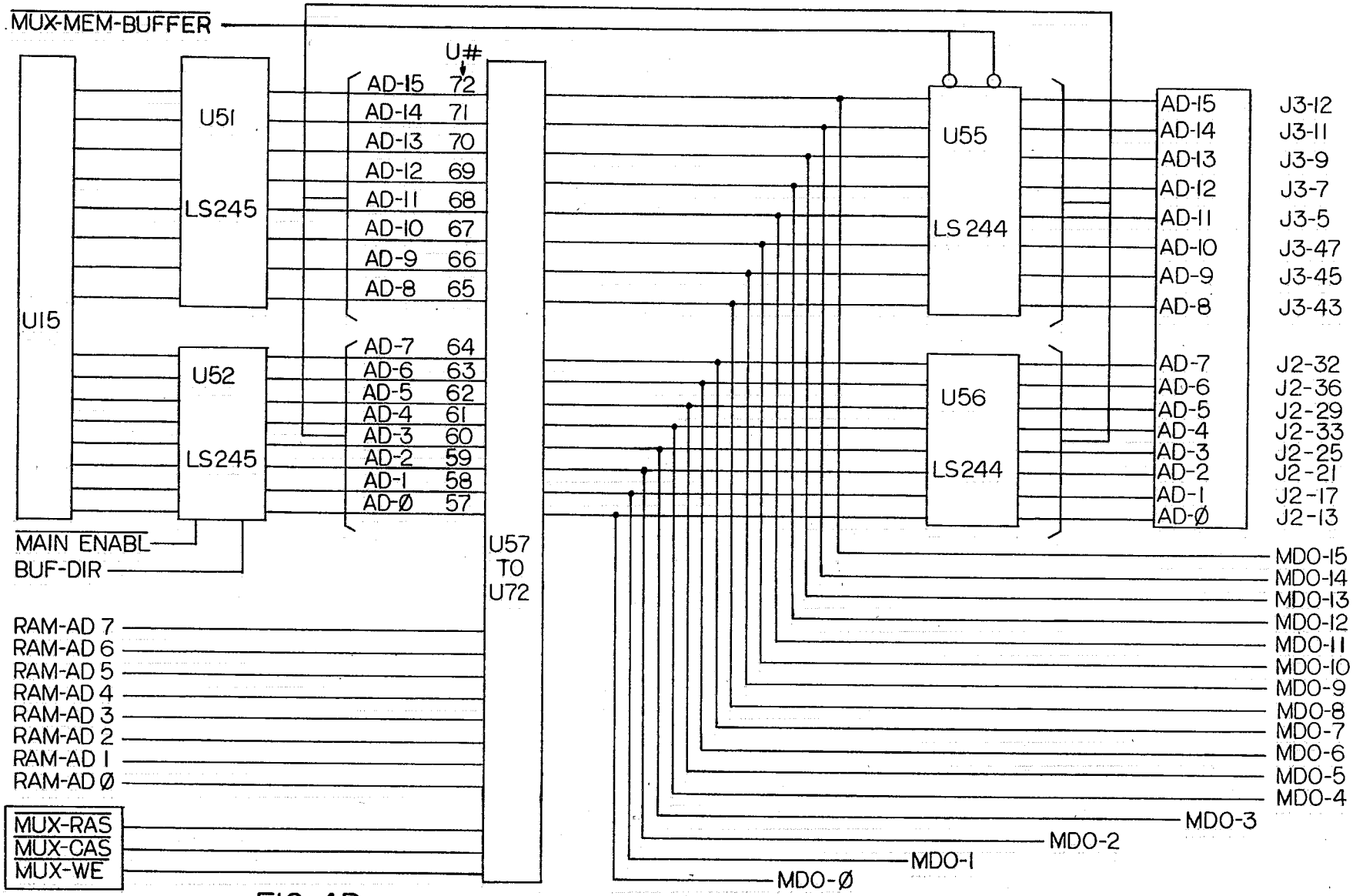
Figure 4C:
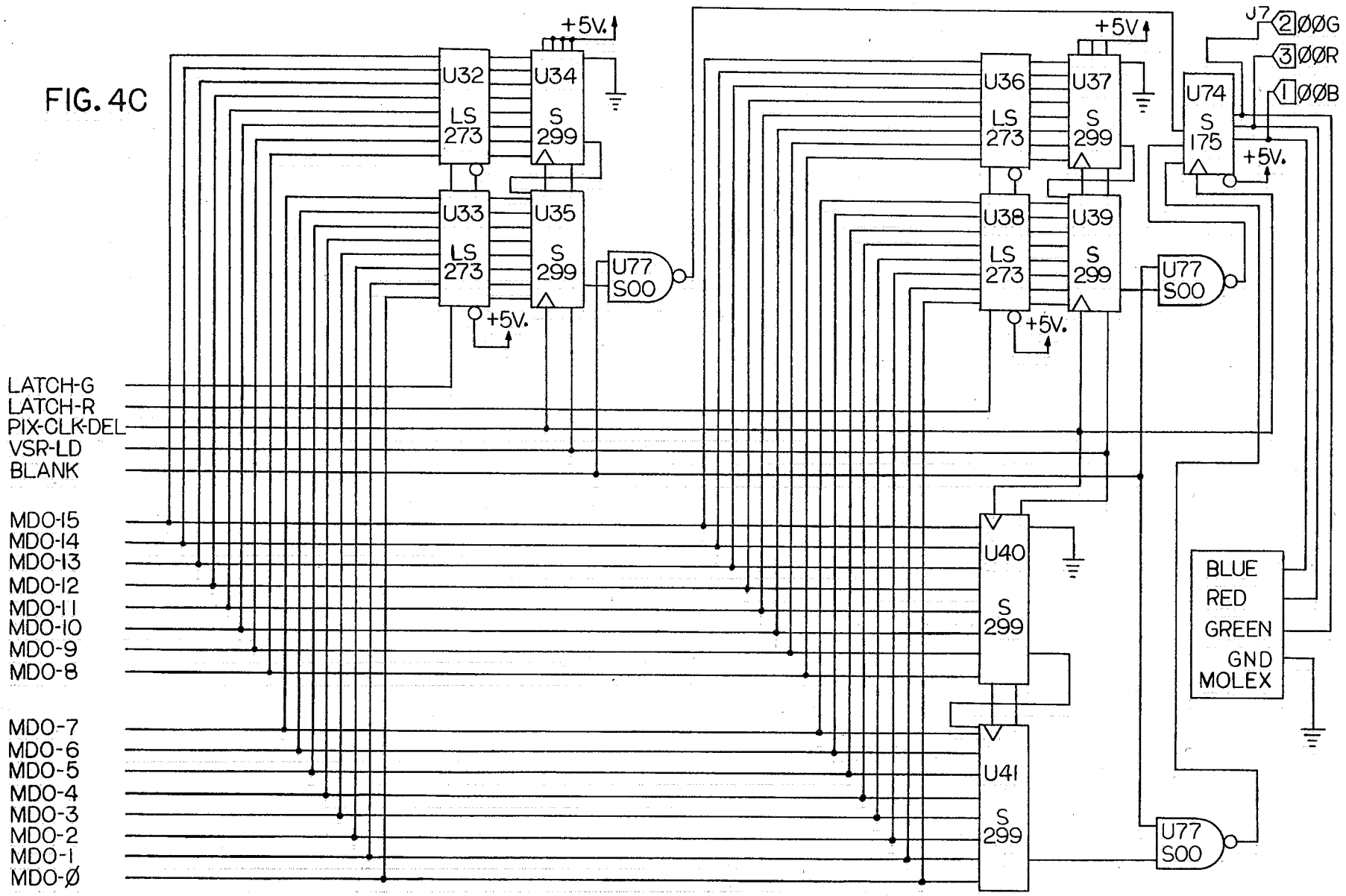

Turning now to FIGS. 4*a*–4*c*, a display memory is initiated with the graphic display control chip 10' (GDC) in FIG. 2 generating an address signal for the current word of memory that needs to go onto the screen. That address signal passes through IC's U25, U22, U23 and the LS244. The trick comes in after the original address from the GDC chip has been read and latched. There is still ample time to read and load two more words out of memory. What happens is to add a constant to the original address, a constant of five, to the top four address lines. This addition of a constant occurs in U24, the adder. At this point the second bit plane has been addressed. A read and load cycle from the second bit plane is stored. Then another constant of A hexadecimal (10) is added to the top four address lines which accesses the third bit plane of the memory. At this time a word from each bit plane is ready to be loaded into the shifter registers.

The actual memory portion of FIG. 2 is illustrated in FIG. 4*b*. The memory chips themselves are shown as U57 to U72. Address lines run in parallel to all sixteen memory chips U57–U72 as are the control lines $\overline{\text{RAS}}$, $\overline{\text{CAS}}$, $\overline{\text{WRITE ENABLE}}$ so each of these sixteen chips gets exactly the same address. Each chip is responsible for one bit in the sixteen bit words to be formed. There are two data lines for each memory chip. Pin 2 is data in and pin 14 is data out. U51 and U52 are buffers which amplify the data signals from the graphic display control chip (GDC) so that several banks of memory chips can be driven. The real heart of the display operation is illustrated on FIG. 4*c*. Latch 46 on FIG. 2 corresponds to U32 and U33 on FIG. 3*c*, and its corresponding shift register 50 on FIG. 2 is shown as U34 and U35. These are the latches and shift registers for the first word of data that is read out of memory during each display cycle. After the first word is read out of memory it is temporarily stored in a latch means, which is latches U32 and U33. There is a control signal called "latch G" or latch green which strobes this data into the latches.

The constant is then added to the address signal to access bit plane #2 and a word from that bit plane is latched in U36 and U38. This operation is initiated by a control signal "latch R" or latch red. Subsequently another constant is added to the memory address signal to access bit plane #3 and obtain a third word. At this point all three bit planes have been addressed and three words are available for the shift registers in either the latches 46 or 48 or on the data lines from the memory chips. These three words are loaded into the appropriate shift registers. At the end of this memory cycle a signal VSR load (video shift load) is generated which, of course, loads the shift registers with the data just read out of memory. Immediately following that operation the data is shifted out of the latch registers onto the display monitor.

Figure 3:
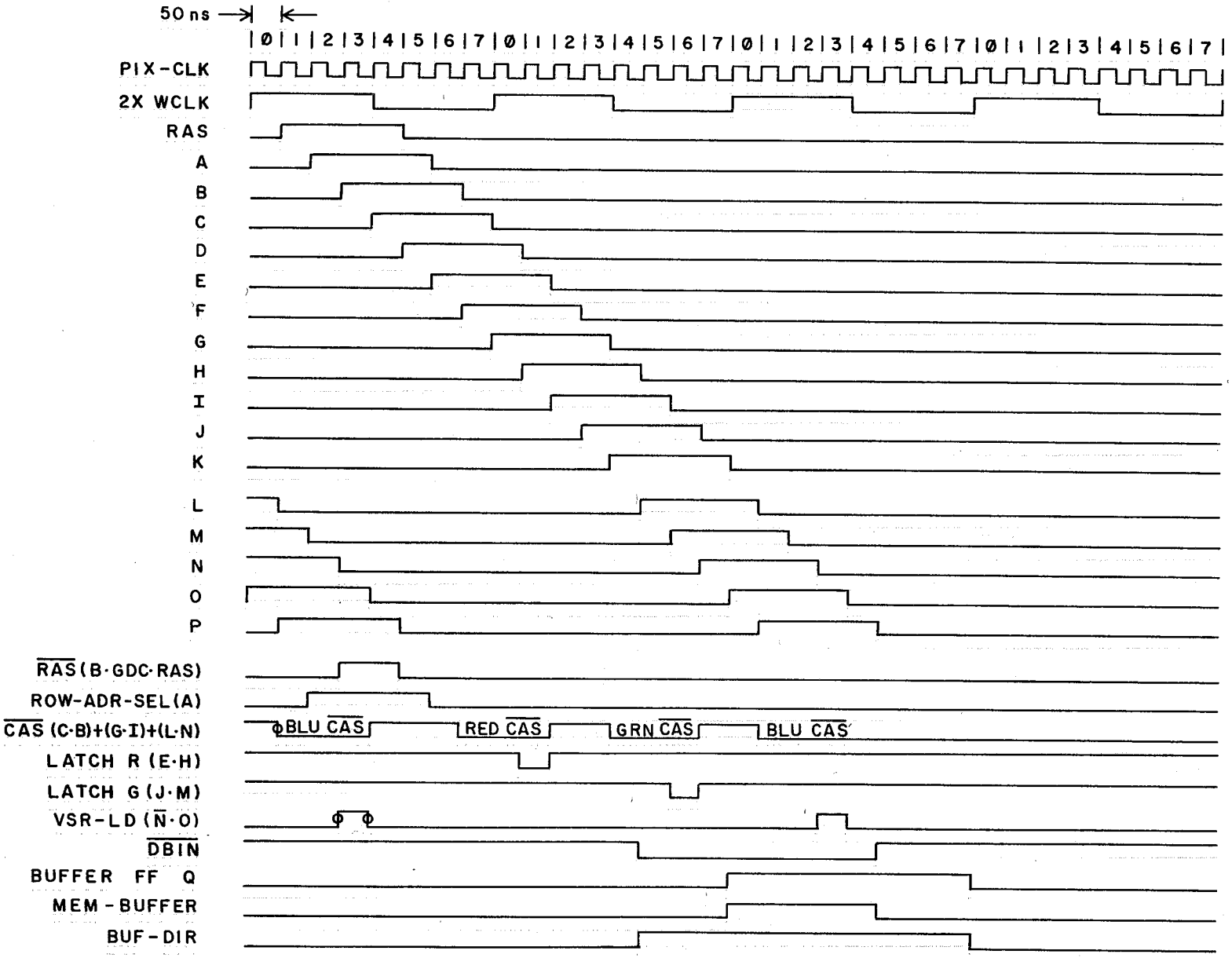
FIG. 3 is a timing diagram for the data processing technique according to the invention.

In FIG. 3, the timing diagram, there is illustrated basically one display memory cycle. The top line is "pixel clock" which generates one pulse every time a pixel is scanned on the screen, which in the case of the present system is 50 nanoseconds. The next important signal on the diagram is called $\overline{RAS}$. $\overline{RAS}$ is the signal that GDC chip puts out to indicate that it's starting the display cycle. That signal is shifted onto lines A through P at times delayed by one pulse of the pixel clock. These are called timing ticks that enable the generation of control signals at the appropriate time. The first control signal to observe is $\overline{RAS}$. $\overline{RAS}$ is generated at a time appropriate to start the memory cycle in each memory chip. $\overline{RAS}$ (row address strobe) is the memory chip control line that strobes in the row address to the memory chip. The other half of the address ($\overline{CAS}$ or column address strobe) is then strobed. Notice that there are three low areas of the $\overline{CAS}$ signal. The signals activate on low so during the low times an address is being strobed in and read from. These times are labeled RED $\overline{CAS}$, GREEN $\overline{CAS}$, BLUE $\overline{CAS}$, on the timing diagram. So what happens is that the memory chips are given a $\overline{RAS}$ strobe and then the RED $\overline{CAS}$. After the data has been read from the memory chips as a result of the RED $\overline{CAS}$, a signal called latch R or latch red is generated. This is the control signal mentioned before that actually latches the data into a latch. At this time another $\overline{CAS}$ cycle is run (green $\overline{CAS}$). The same thing here happens in the second bit plane. The final $\overline{CAS}$ is blue $\overline{CAS}$ and the falling edge of that signal strobes in the final address for this particular memory cycle. VSR load (video shift register) is the final signal generated that shifts all of the data previously read into the shift registers for subsequently transfer to the CRT screen. While a preferred embodiment of the invention has been described in detail, various changes and modifications might be made without departing from the scope of the invention which is set forth in the claims below.

What is claimed is:

1. Memory output control circuit for transmitting read data to a computer color graphic imaging system of the type in which a plurality of pixels, each of which is operated by three input color guns, are arranged across the face of the screen and operated responsive to said read data from a memory system, a plurality of data bits from the memory system determining the color of each pixel, said apparatus comprising:

(a) a frame buffer formed of a bank of random access memory chips collectively including data bits sufficient in number such that there is a separate data bit for each input color gun of each pixel;

(b) said frame buffer being divided into three bit planes;

(c) three shift registers, each of which corresponds to one of said bit planes;

(d) a latch means connecting the first and second bit planes to separate ones of said shift registers, the third bit plane being connected directly to the third shift register;

(e) a graphic display control means for generating an address signal during each display cycle;

(f) adding means connecting said graphic display control means and said frame buffer for converting each address signal from said controller means into three read signals, one to each of said bit planes, at spaced time intervals during each display cycles;

whereby the graphic display control means addresses and transfers three words from three bit planes into shift registers during each display cycle.

2. The memory output control circuit according to claim 1 wherein said graphic display control means requires N-bits to be read out of said frame buffer responsive to each address, which N-bits multiplied by the bit capacity of each random access memory chip exceeds by at least three times the number of data bits required from each bit plane.

3. The memory output control circuit according to claim 1 wherein said graphic display control means is an NEC 7220 integrated circuit, and said random access memory chips are 64K bit wide.

4. The memory output control circuit according to claim 1 wherein substantially one-third of the data bits on each memory chip are arranged to fall in each of said bit planes.

5. A method for processing data from a frame buffer to the pixels of a color monitor utilizing a graphic display control chip that has a display cycle at least three times as long as the memory cycle of the frame buffer and is designed to operate with an N-bit memory output, said method comprising the steps of:

(a) dividing said frame buffer into three bit planes;

(b) generating an address signal to a first one of said bit planes from said control chip at the outset of the display cycle;

(c) reading and latching an N-bit word of information from said first bit plane;

(d) adding a first constant to said address signal at a time later in said same display cycle, which provides an address signal to said second bit plane;

(e) reading and latching an N-bit word of information from said second bit plane;

(f) adding a second constant to said address signal at a time still later in said same display cycle which provides an address signal to said third bit plane; and (g) reading an N-bit word of information from said third plane and loading all said words from said first, second and third bit planes simultaneously into shift registers from which they are transmitted to said pixels.

6. The method according to claim 5 wherein said frame buffer is formed by (N) memory chips, and substantially one-third of the data bits on each memory chip are arranged to lie in each bit plane.

7. The method according to claim 5 wherein steps (b), (d), and (f) are accomplished by strobing in a row address followed by a column address strobe for the read from the first bit plane, followed by the column address strobe for the read from the second bit plane, and again followed by the column address strobe for the read from the third bit plane.

* * * * *